US006064849A

United States Patent [19]

Honda et al.

[11] Patent Number: 6,064,849

[45] Date of Patent: May 16, 2000

[54] IMAGE FORMING APPARATUS FOR HIGH QUALITY COLOR IMAGES

[75] Inventors: Shin Honda; Kouji Hamabe; Ryouichi Tsuruoka; Norio Ogawahara, all of Saitama, Japan

[73] Assignee: Fuji Xerox Co., Ltd., Tokyo, Japan

[21] Appl. No.: 09/238,589

[22] Filed: Jan. 28, 1999

[30] Foreign Application Priority Data

Jan. 30, 1998 [JP] Japan ..... 10-23381
Feb. 4, 1998 [JP] Japan ..... 10-33809

[51] Int. Cl.[7] ..... G03G 15/01; G03G 15/16

[52] U.S. Cl. ..... 399/302; 399/223; 399/313

[58] Field of Search ..... 399/302, 308, 399/313, 66, 223

[56] References Cited

U.S. PATENT DOCUMENTS 5,812,919 9/1998 Takano et al. ..... 399/313 X

FOREIGN PATENT DOCUMENTS 5-134556 5/1993 Japan .

9-152791 6/1997 Japan .

*Primary Examiner*—Susan S. Y. Lee

*Attorney, Agent, or Firm*—Finnegan, Henderson, Farabow, Garrett & Dunner, L.L.P.

[57] ABSTRACT

The image forming apparatus according to the present invention forms a high quality color image with multiple colors of toner in accordance with an input signal. An electrostatic latent image is formed on an image carrier in accordance with the image signal. A developing bias is applied to the image carrier to form a toner image of the latent image for multiple toner colors. To transfer the toner image to an intermediate transfer belt, a rotatable transfer roller is positioned opposite the image carrier and across the transfer belt for attracting the transfer belt toward the image carrier at a transferring position. To reduce the frictional force between the image carrier and the transfer belt, which causes color deviation when multiple toner images are transferred to the intermediate transfer belt, a toner is placed on the image carrier in front of a leading end of a first toner image formed on the image carrier. The toner is applied to the transfer belt when the image carrier is in contact with the transfer belt and thus reduces the frictional force causing color deviation.

15 Claims, 10 Drawing Sheets

IMAGE FORMING APPARATUS FOR HIGH QUALITY COLOR IMAGES

BACKGROUND OF THE INVENTION

The present invention relates to an image forming apparatus, such as an electrophotographic copying machine or a laser printer, and more particularly to an image forming apparatus incorporating an image carrier (for example, a photosensitive drum) around which a toner image will be formed and which is rotated around a predetermined axis; an endless belt serving as an intermediate transfer member so as to form an image; the intermediate transfer belt arranged to be moved in a predetermined movement direction along a predetermined loop passage while the transfer belt is making contact with the outer surface of the image carrier; and a transfer roller disposed opposite to the image carrier across the transfer belt in such a manner as to press the transfer belt against the image carrier and arranged to be rotated around a predetermined axis so as to transfer the toner image formed on the image carrier to the transfer belt.

An image forming apparatus, such as a copying machine or a printer of an electrophotographic type, is adapted to a method by which a non-fixed toner image formed on a latent-image carrier, such as a photosensitive drum, is transferred to a recording medium, such as a paper sheet so as to print an image. As a method of transferring the non-fixed toner image to the recording medium, a method is known whereby the non-fixed toner image is directly transferred to the recording medium. Another method is known in which the non-fixed toner image is primarily transferred to the surface of an intermediate transfer member in the form of a drum or an endless-belt film member. Then, the non-fixed toner image on the intermediate transfer member is secondarily transferred to a recording medium so as to obtain a copied image.

FIG. 17 is a schematic view showing an essential structure of a color printer taken as an example of the image forming apparatus incorporating the belt-type intermediate transfer member. Referring to the drawing, the surface of a latent image carrier, such as a photosensitive drum, (hereinafter represented by a "photosensitive drum") 1, is uniformly electrically charged by an electric charger 2 with a predetermined electric charge. An image writing unit (ROS) (not shown) performs writing scan using a laser beam L so that an electrostatic latent image corresponding to a first-color image signal is formed. The electrostatic latent image reaches a position opposite to a first-color developing unit of the developing unit 3 when the photosensitive drum 1 has been rotated in a direction A. Then, the electrostatic latent image is developed by the first-color developing unit using toner. The photosensitive drum 1 furthermore rotates while carrying a toner image T.

In synchronization with the toner developing operation, the intermediate transfer belt 4 is moved at substantially the same velocity as the peripheral velocity of the photosensitive drum 1. In a primary transferring portion, a primary transfer roller 5 is disposed adjacent to a position immediately below a position at which the photosensitive drum 1 and the intermediate transfer belt 4 are in contact with each other. The primary transfer roller 5 is disposed to be in contact with the intermediate transfer belt 4. In the primary transferring portion, the toner image T carried by the photosensitive drum 1 is primarily transferred to the intermediate transfer belt 4 with a transferring electric field (a transferring bias) having a polarity opposite to the polarity charged to the toner which is applied to the primary transfer roller 5. Thus, a primary transferring rotation for one color is completed.

As a result of a rotational movement of the intermediate transfer belt 4, the toner image primarily transferred to the intermediate transfer belt 4 arrives at a secondary transferring portion in which a secondary transfer roller 6 is disposed. In a case of a full color image forming apparatus, the process from formation of the latent image to the primary transference of the toner image is repeated for predetermined colors (in general, yellow (Y), magenta (M), cyan (C) and black (Bk)). Thus, a color toner image is formed on the intermediate transfer belt 4 by superimposing the toner in a plurality of colors.

To form a toner image in each color, the developing unit 3 comprises a rotary unit consisting of developing units in four color, that is, a yellow developing unit $\mathbf{3}_{-1}$, a magenta developing unit $\mathbf{3}_{-2}$, a cyan developing unit $\mathbf{3}_{-3}$ and a black developing unit $\mathbf{3}_{-4}$. Thus, latent images in the foregoing colors formed on the photosensitive drum 1 can sequentially be developed.

A toner image in a first color carried by the photosensitive drum 1 is transferred to the intermediate transfer belt 4 in the primary transferring portion. Then, a residual portion of the toner on the photosensitive drum 1 is removed by a photosensitive-member cleaner 7. Moreover, a destaticizer (not shown) neutralizes the electric charge. Then, a latent image corresponding to a second color is formed. The latent image in the second color is developed similarly to that in the first color. The toner image in the second color is superimposed on the transferred toner image in the first color and formed on the intermediate transfer belt 4 so as to be transferred. Toner images in the third and following colors are similarly transferred to the intermediate transfer belt 4 in a superimposition manner. As a result, a color toner image is formed on the intermediate transfer belt 4 by superimposing non-fixed toner in the plural colors.

When the intermediate transfer belt 4, to which the toner images in all of the colors have primarily been transferred, reaches a secondary transferring position, a recording paper sheet P which is a recording medium fed from the paper feeding tray 8 at adjusted timing is moved to the secondary transferring position.

When the recording paper sheet P is held by the secondary transfer roller 6 and the intermediate transfer belt 4 so as to be moved, the toner image on the intermediate transfer belt 4 is secondarily transferred to the recording paper sheet P with a transferring electric field produced by transferring voltage having a polarity opposite to the polarity charged to the toner image. The recording paper sheet P to which the toner image has secondarily be transferred is moved to the fixing unit 9 so as to be subjected heating and pressurizing processes so as to fix the toner image to the recording paper sheet P. Thus, an image forming process is completed.

The secondary transfer roller 6 is disposed to be brought into contact with the intermediate transfer belt 4 and separated from the same in a direction indicated with an arrow C. In synchronization with introduction of the recording paper sheet P, the secondary transfer roller 6 makes contact with the intermediate transfer belt 4. In synchronization with discharge, the secondary transfer roller 6 is separated from the intermediate transfer belt 4. When the secondary transference has been completed, the secondary transfer roller 6 is returned to a standby position. Also a cleaner 10 disposed opposite to the intermediate transfer belt 4 is brought into contact with the intermediate transfer belt 4 and separated from the same similarly to the second transfer roller 6 to clean the toner image omitted from transference to the recording paper sheet P.

The intermediate transfer belt 4 is arranged by a drive roller 11, an idle roller 12, a secondary-transference backup roller 13 and a tension roller 14 so as to be moved in a direction indicated with an arrow B by the drive roller 11. The intermediate transfer belt 4 is provided with ribs (not shown) so that the positions in the axial directions of each roller including the drive roller 11 are limited, the ribs being provided on the inner periphery of the side portions. To reinforce the intermediate transfer belt, a belt reinforcing tape is applied to the outer periphery of the side portions.

The color image forming apparatus incorporating the intermediate transfer belt is arranged to collectively transfer, to the recording medium, a synthesized toner image (an image formed by superimposing color toner images) which has been transferred to the intermediate belt in the superimposition manner. Therefore, the foregoing apparatus has an advantage that deviation of the positions of toner images and disorder of a formed image can effectively be prevented when a method is employed in which color toner images are sequentially and directly transferred from the latent image carrier to the recording medium. Note that an example of the image forming apparatus incorporating the intermediate transfer belt is disclosed in Unexamined Japanese Patent Publication No. 5-134556.

However, the image forming apparatus incorporating the intermediate transfer belt has the following problems. An ideal structure of the above-mentioned image forming apparatus is that the peripheral velocity VD of the photosensitive drum 1 and the movement velocity VB of the intermediate transfer belt 4 are the same, that is, the relative velocity is zero. However, the outer diameter of the drive roller 11 of the intermediate transfer belt 4 and that of the photosensitive drum 1 have tolerances. Therefore, the two velocities are slightly different from each other and thus a relative velocity is inevitably produced.

When a transferring bias is applied to the primary transfer roller 5, the photosensitive drum 1 and the intermediate transfer belt 4 attract each other so as to be brought into intimate contact with each other. Since the photosensitive drum 1 and the intermediate transfer belt 4 brought into intimate contact with each other have a relative velocity, forces are exerted on the photosensitive drum 1 and the intermediate transfer belt 4.

An assumption is made that the velocity VD of the photosensitive drum 1 is larger than the velocity VB of the intermediate transfer belt 4. Force in the rotating direction B of the intermediate transfer belt 4 is exerted on the intermediate transfer belt 4. The force causes the intermediate transfer belt 4 to be loosened between the primary transfer roller 5 and the drive roller 11. On the other hand, force opposing the rotational direction A of the photosensitive drum 1 is exerted on the photosensitive drum 1. As a result, the position of the photosensitive drum 1 is shifted. The looseness of the intermediate transfer belt 4 and shift of the position of the photosensitive drum 1 cause color deviation when multi-color toner is transferred.

The forces exerted on the intermediate transfer belt 4 and the photosensitive drum 1 are produced when the foregoing elements are brought into intimate contact with each other. Therefore, if their friction coefficients are small, color deviation satisfies an allowable range. If toner particles exist on the photosensitive drum 1, the toner particles serve as a material for reducing friction. Thus, the frictional force can be reduced.

After the toner images on the intermediate transfer belt 4 have been transferred to the recording paper sheet P, the intermediate transfer belt 4 is cleaned by the cleaner 10 so that the toner particles are removed. Therefore, large frictional force of the photosensitive drum 1 and the intermediate transfer belt 4 is exerted immediately before the primary transference of the first color of a first print. However, the frictional force is reduced after start of the primary transference to transfer the toner image to the intermediate transfer belt 4. Also in the transference of the second and following colors which is performed after the process for the first color has been performed and in the all color transference of two and following pages of a continuous job, existence of toner particles results in reduction in the frictional force.

As a result, the extent of the deviation of the photosensitive drum 1 and that of the looseness of the intermediate transfer belt 4 vary between start of the primary transference of the first color and a following moment of time. As a result of the foregoing phenomenon, there arises a problem of the intermediate transfer belt 4 in that the position of the leading end of an image in only the first color image of a first page is deviated from second and following colors. The foregoing problem can be prevented when combination of the materials of the photosensitive drum 1 and the intermediate transfer belt 4 has a small coefficient of friction. However, a combination of materials of the photosensitive drum 1 and the intermediate transfer belt 4 having characteristics required to form an image and enabling the frictional force to be reduced has not been known.

Besides, in Unexamined Japanese Patent Publication No. 9-152791, there is disclosed an image forming apparatus in which toner images in all colors are transferred to the intermediate transfer belt by a transfer roller and a final toner image is thus formed thereon, and the final toner image is then transferred therefrom to a paper sheet to form a color image.

The color image forming apparatus incorporating the intermediate transfer belt is structured to collectively transfer, to a paper sheet, a synthesized toner image (an image obtained by superimposing color toner images) formed on the intermediate transfer belt in the superimposition manner. Therefore, the foregoing apparatus has an advantage that displacement of toner images and disorder of the formed image experienced with the method in which color toner images are sequentially and directly transferred from the photosensitive drum to a paper sheet can effectively be prevented.

The above-mentioned color image forming apparatus incorporates the transfer roller for transferring toner images from the photosensitive drum to the intermediate transfer belt. The transfer roller is disposed opposite to the photosensitive drum across the intermediate transfer belt and urged in such a manner as to press the intermediate transfer belt against the photosensitive drum. At this time, the transfer roller is usually urged at positions adjacent to two axial directional ends.

Therefore, the pressing load generated by the transfer roller is enlarged at each of both end portions as compared with that at a central portion with respect to axial direction of the roller. Therefore, the width (hereinafter called a "nip width") of the contact region between the intermediate transfer belt and the photosensitive drum in a conveying direction of the belt is enlarged at the both end portions as compared with the central portion. Namely, in the contact region T between the intermediate transfer belt and the photosensitive drum shown in FIG. 14, nip width at the central portion W1 and nip width at the both end portions W2 satisfy the following relationship:

$W1<W2$.

If the nip width values are dispersed in the axial direction, a synthesized resistance value including the photosensitive drum, the transfer roller and the intermediate transfer belt is dispersed in the axial direction. When toner images formed on the image carrier are transferred to the intermediate transfer belt by the transfer roll, a uniform transferring electric field cannot be realized. As a result, there is apprehension that partial irregularity in transference occurs. Therefore, the conventional apparatuses must raise the transferring voltage so as to intensify the transferring electric field in order to prevent partial irregularity occurring in a transferring operation.

If the transferring voltage is raised, the transferring voltage, however, is raised excessively in a portion in which the synthesized resistance value is small. As a result, a transferring current is introduced into toner on the intermediate transfer belt. Therefore, the charged polarity of a portion of toner is inverted, causing a defect to take place in transference. As described above, the color image forming apparatus incorporating the intermediate transfer belt cannot easily realize excellent transferring performance by optimizing the transferring voltage.

SUMMARY OF THE INVENTION

It is therefore the first object of the present invention is to provide an image forming apparatus which is capable of reducing the force for bringing a photosensitive drum and an intermediate transfer belt into contact with each other produced when a transferring bias has been applied so as to prevent color deviation between a first color and following colors and enables an excellent image to be obtained.

And the second object of the present invention is to provide an image forming apparatus which is capable of solving a defect in transference and maintaining the quality of a transferred image at a level not lower than a predetermined level.

In order to achieve the above objects, there is provided an image forming apparatus for forming a color image with plural colors of toner in accordance with an input image signal, the image forming apparatus comprising: a rotatable image carrier having a shaft as a rotation axis; image writing means for forming an electrostatic latent image on the image carrier in accordance with the image signal; developing means for applying a developing bias to the image carrier to visualize the latent image as a toner image with the plural colors of toner; a transfer belt an outer surface of which is contacted with an outer peripheral surface of the image carrier while being conveyed in a predetermined conveying direction along a predetermined loop passage; a rotatable transfer roller having a shaft as a rotation axis, the transfer roller disposed opposite to the image carrier across the transfer belt for urging the transfer belt toward the image carrier at a transferring position; and friction reducing means for reducing friction between the image carrier and the transfer belt before a leading end portion of the toner image for the first color arrives at the transferring position.

The image forming apparatus further comprises bias applying means for applying a transfer bias to the image carrier to transfer the visualized toner image onto the transfer belt to serve as the friction reducing means, wherein the bias applying means starts to apply the transfer bias in a period of time from start of the latent image forming for the first color performed by the image writing means to the arrival of the leading end portion at the transferring position.

The image forming apparatus may further comprise an identifier provided on the transfer belt; and sensor for detecting the identifier to identify the present position of the transfer belt in the loop passage and for outputting a reference signal, wherein the image writing means starts the latent image formation of the first color in response to the output of the reference signal and the bias applying means starts the application of the transfer bias after a lapse of a predetermined time from the output of the reference signal.

Since the transfer bias is applied immediately before the leading end portion of the toner image for the first color reaches the transferring position, an amount of deviation of the transfer belt, caused by the frictional force produced between the image carrier and the transfer belt by dint of the transferring bias, is not enlarged to an amount by which deviation of an image in the first color takes place.

The developing means may start to apply the developing bias for the first color to serve as the friction reducing means at least one rotation of the transfer belt prior to the start of latent image forming for the first color performed by the image writing means.

In the apparatus, the developing bias may be applied to an image center portion on the transfer belt.

Since the apparatus is configured such that toner serving as the low friction material is placed on the image carrier at a position in front of the leading end of the toner image for the first color, an amount of deviation of the transfer belt, caused by the frictional force produced between the image carrier and the transfer belt by dint of the transferring bias, is not enlarged to an amount by which deviation of an image in the first color takes place.

The apparatus may further comprise cleaning means for reducing toner adhered to the transfer belt prior to the start of latent image forming for the first color.

Accordingly, contamination in the image forming region caused by the toner can be prevented.

The image forming apparatus may further comprises: a frame in which a motor for driving the image carrier is securely mounted; and a housing detachably mounted in the frame and having a bearing for rotatably supporting one end of the shaft of the image carrier, wherein the other end of the shaft is engaged with a shaft of the motor and supported thereby when the housing is mounted in the frame.

Accordingly, this structure for supporting the image carrier enables the image carrier to easily be attached/detached to and from the image forming apparatus. Thus, workability in changing and inspecting the apparatus can be improved.

In the image forming apparatus, a nip shape index represented by a ratio of a contact area width of the image carrier and the transfer belt at an end portion of the transfer roller with respect to an axial direction thereof to that at a central portion of the transfer roller with respect to the axial direction is set within a range of $(1\pm x)$, where x is an allowable value determined under a setting condition of the apparatus. The value of x may be 0.3.

If the nip shape index is 1, the contact area width (nip width) at the end portion and that at the central portion are equal. Therefore, dispersion of the nip width in the axial direction can be prevented. Thus, partial irregularity in transference occurring when toner images on the image carrier are transferred to the transfer belt can be prevented.

When the nip shape index is set with in the above range, the nip width at the end portion and that at the central portion are substantially the same. As a result, dispersion of the nip width in the axial direction can be limited to satisfy the allowable range. Thus, partial irregularity in transference occurring when toner images on the image carrier are transferred to the transfer belt can be prevented. Therefore, the quality of transferred image not lower than a predetermined level can be maintained.

FIG. 10 shows grades of transference (i.e., values of evaluation of qualities of transferred images with numerals 0 to 4) corresponding to nip shape indexes. When the transference grade is close to 0, further satisfactory qualities of the transferred images can be obtained. If the transference grade is 2 or smaller, the level indicates a satisfactory quality of transferred image.

When the nip shape index is set to satisfy the range shown in FIG. 10 in which the transference grade is 2 or smaller, a satisfactory level of the quality of the transferred image can be maintained. Specifically, it is preferable that the allowable value is set to be 0.3 and the nip shape index is set to be not less than 0.7 nor more than 1.3.

In the apparatus, the central portion may be defined as an arbitrary portion in a central area derived by dividing the transfer roller into three equal areas in the axial direction, and the end portion may be defined as an arbitrary portion in one of both side areas derived by the dividing.

Alternatively, the central portion may be defined as a portion corresponding to a central portion in a central portion of a toner image transferred area with respect to axial direction of the transfer roller, and the end portion may be defined as a portion corresponding to one of both side end portions of the toner image transferred area.

Since the transfer roller is generally urged at the both ends, the pressing load of the transfer roller is enlarged at the both ends as compared with that at the central portion. Therefore, the nip width at the end portion is usually larger than that at the central portion (see FIG. 14).

In the apparatus, an outer diameter of the transfer roller may be gradually enlarged from both side end portions toward a central portion along an axial direction thereof.

Accordingly, dispersion of the pressing load of the transfer roll in the axial direction can be corrected.

When the outer shape of the transfer roller is simply devised, dispersion of the pressing load of the transfer roller can easily be corrected. Thus, partial irregularity in transference can be prevented. As a result, the quality of transferred image not lower than a predetermined level can be maintained.

When the difference between a maximum value of the outer diameter and a minimum value of the same is too large, there is apprehension that irregularity in transference occurs owning to the difference in the outer diameter. Therefore, it is preferable that the difference between the maximum value of the outer diameter and the minimum value of the same satisfies a range from 0.1–0.9% of an average value of the outer diameters.

In the apparatus, the transfer roller may be disposed such that the shaft thereof makes a predetermined angle with respect to a plane perpendicular to the transfer belt and including the shaft of the image carrier. The angle (amount of transfer roll skew) is determined in accordance with the nip shape index.

FIG. 13 shows nip shape indexes corresponding to variation in the amounts of skews of the transfer roller. When the nip shape index is 0.8 if the amount of the skew of the transfer roll is 0° as shown in FIG. 13 (when the axis of the image carrier, the surface of the transfer belt which is in contact with the image carrier and the axis of the transfer roller are in parallel with one another as usual), the nip shape index is about 1 if the amount of the skew of the transfer roll is ±1°. When the amount of the skew of the transfer roll is ±2°, the nip shape index is about 1.2.

Therefore, in the example shown in FIG. 13, it is preferable that the axis of the transfer roller is inclined such that the amount of the skew of the transfer roller satisfies a range (for example, −2 to +2) with which the nip shape index satisfies the range from 0.7 to 1.3. As a result, the nip shape index is able to satisfy the range from 0.7 to 1.3. Thus, the partial irregularity in transference can be prevented. As a result, the quality of transferred image not lower than a predetermined level can be maintained.

In the apparatus, the transfer roller may be arranged at a near downstream portion of the conveying direction with respect to a contact region of the image carrier and the transfer belt.

In this case, vibrations of the transfer roll produced when a transference operation is performed can be prevented as compared with a structure in which the transfer roller is disposed immediately below the contact region. Thus, variation of the pressing load of the transfer roller can be prevented. As a result, partial irregularity in transference can furthermore satisfactorily be prevented.

DETAILED DESCRIPTION OF THE PREFERRED EMBODIMENTS

Figure 17:
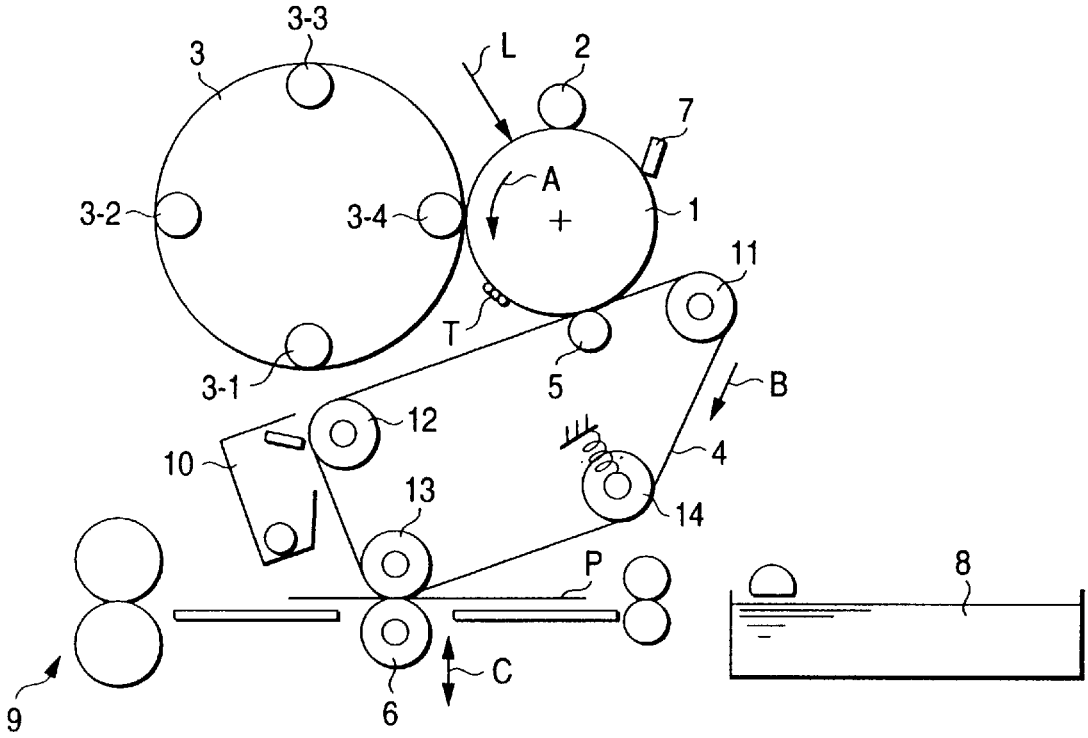
FIG. 17 is a schematic view showing an essential structure of the image forming apparatus.

Referring to the drawings, a color image forming apparatus according to the present invention will now be described. The structure and operation described with reference to FIG. 17 are cited if necessary and description will be made also with reference to FIG. 17.

Figure 2:
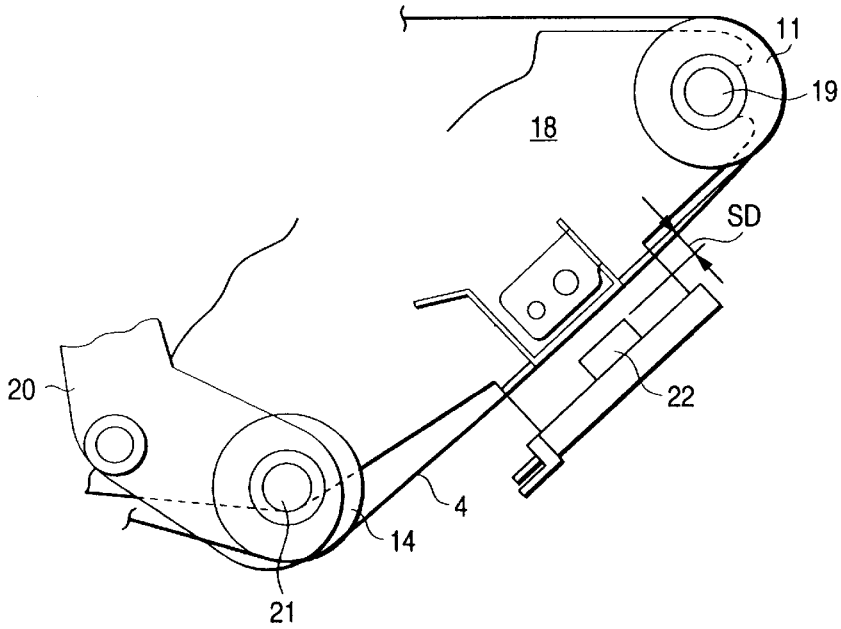
FIG. 2 is an enlarged view showing an essential portion of the positional relationship between an intermediate transfer belt and a reflection-type sensor.

FIG. 2 is an enlarged view showing an essential portion of a state in which a reflection-type sensor for detecting a reference position on an intermediate transfer belt 4 has been joined. In the drawing, a drive roller 11 is, through a shaft 19, supported by a side frame 18 which constitutes a belt unit. The tension roller 14 is, with a shaft 21, supported by a bracket 20 swingably retained by the side frame 18. The intermediate transfer belt 4 is arranged by rollers including the drive roller 11, the tension roller 14, the idle roller 12 and the secondary-transference backup roller 13 so as to be applied with a predetermined tension from the tension roller 14. A reflection-type sensor 22 for detecting a reference position is disposed between the drive roller 11 and the tension roller 14. The reflection-type sensor 22 is directly secured to the side frame 18 so as to prevent change in the distance SD from the intermediate transfer belt 4.

In a region of the intermediate transfer belt 4 on which no image is formed, that is, at a position adjacent to an end of the shaft 19, a marking (a reflecting tape or the like) which is detected by the reflection-type sensor 22 is applied. In a state in which the movement of the intermediate transfer belt 4 is interrupted, the marking is positioned between the reflection-type sensor 22 and the drive roller 11. Timing of the ROS to write an image by using the laser beam L and timing at which the transferring bias is applied are determined in response to a marking detection signal output from the reflection-type sensor 22.

Figure 1:
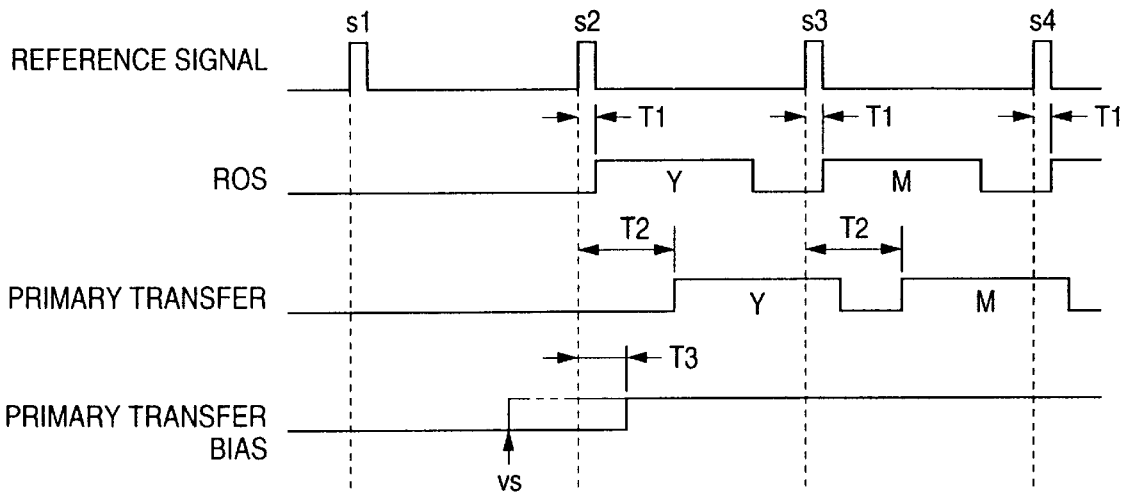
FIG. 1 is a time chart of essential operations of an image forming apparatus of a first embodiment according to the present invention.

FIG. 1 is a time chart of essential portions of the color image forming apparatus according to a first embodiment. Referring to the drawing, the marking detection signal (the reference signal) is output whenever the intermediate transfer belt 4 rotates one time. The ROS starts writing in response to first transition of reference signals s1 to s4. It is preferable that a margin of time T1 (for example, 50 msec) is provided. That is, after the first transition of the reference signal s2 for the second rotation, a Y image is written on the photosensitive drum 1. After first transition of the reference signal s3 for the third rotation, M image is written on the photosensitive drum 1. Similarly, C and K images are written on the photosensitive drum 1.

When the photosensitive drum 1 has been rotated and thus the image writing position has arrived at the primary transferring position, that is, after a lapse of T2 from the first transition of the reference signal, developed toner images in the colors are primarily transferred to the intermediate transfer belt 4. Prior to the primary transference, a transferring bias is applied to the primary transfer roller 5. The transferring bias is applied after a lapse of T3 from the first transition of the reference signal s2 for the second rotation.

When the transferring bias has been applied to the primary transfer roller 5, displacement of the photosensitive drum 1 and distortion of the intermediate transfer belt 4 are accumulated as application time is elongated. That is, as time elapses from start of application of the transferring bias, looseness of the intermediate transfer belt 4 and displacement of the photosensitive drum 1 become great which are caused from the difference between the peripheral velocity VD of the photosensitive drum 1 and the movement velocity VB of the intermediate transfer belt 4. Thus, color deviation takes place from the images in the second and following colors.

In this embodiment, time (T2−T3) from start of application of the transferring bias to start of primary transference of the first color is made to be shortest time T3 in a range in which the bias applied to the primary transfer roller 5 can be raised to an extent which does not exert an adverse influence on the transferring performance of toner.

As described above, time (T2−T3) is made to be shortest so that a process for forming a first color is performed in a state in which deviation of the position of the photosensitive drum 1 caused from the frictional force produced between the photosensitive drum 1 and the intermediate transfer belt 4 can be reduced. As a result, deviation of the position at which an image is written by the ROS can be reduced. Thus, deviation of the leading end of an image in the first color from images in the second and following colors can be prevented.

With the conventional technique, application of the primary transferring bias is started at least before the reference signal s2 (for example, intermediate time vs between the reference signals si and s2) for starting writing of an image in a first color which is performed by the ROS. If the transferring bias is applied during writing of an image, an influence of the application of the transferring bias is exerted on the photosensitive drum 1. In this case, the difference in the density of images before and after the application of the transferring bias occurs. As a result of experiments performed by the inventors of the present invention, start of the application of the transferring bias during writing of an image by the ROS did not result in any difference in the density of the image.

Figure 3:
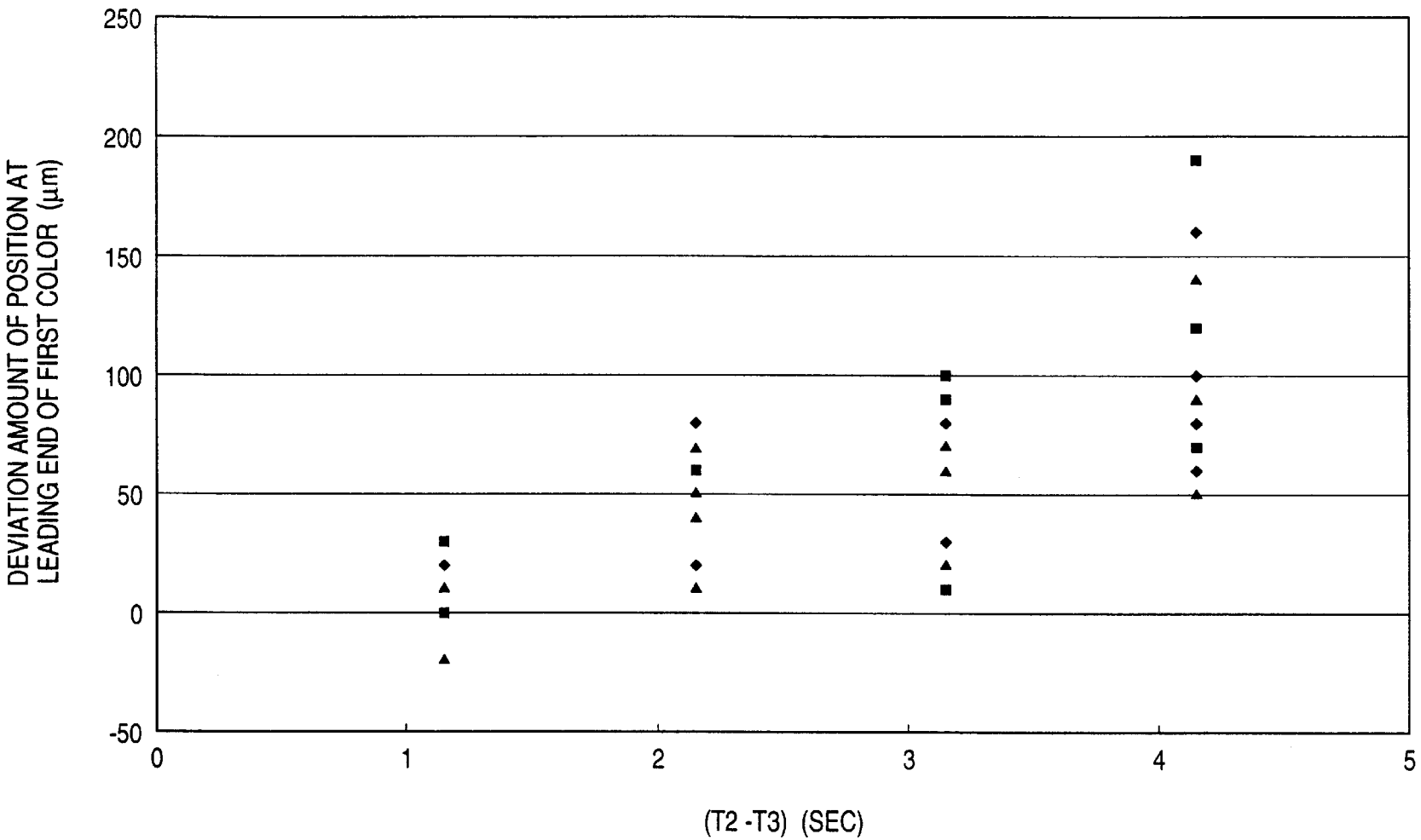
FIG. 3 is a graph showing an amount of deviation of the leading end of a first color such that timing at which a transferring bias is applied is employed as a parameter.

FIG. 3 is a graph showing the relationship between time (T2−T3) and amounts of color deviation at the leading end of the first color with respect to the second color. As can be understood from the graph, the amount of color deviation is reduced as time (T2−T3) is shortened and thus the quality of the image is improved. The cause of the color deviation is not limited to the relative velocity between the peripheral velocity VD of the photosensitive drum 1 and the movement velocity VB of the intermediate transfer belt 4. Also another disturbance causes the color deviation to occur. Therefore, it is preferable that time (T2−T3) is shortest. Since the primary transfer roller 5 is able to raise the transferring bias to a level required for transference in about 0.1 second after start of the application of the transferring bias, time (T2−T3) is set to be 0.1 second or longer. Thus, deterioration in the image quality caused from defective transferring characteristic of toner can be prevented.

It is preferable that timing at which the transferring bias is applied is controlled in accordance with time taken from the reference signal from a viewpoint of simply performing the control. Since time T2 from the reference signal to start of the primary transference was measured in a test machine, time T3 is 1.8 seconds if the assumption is made that time (T2−T3) is 0.1 second. That is, it is preferable that time T3 is 0 second to 1.8 seconds for the purpose of realizing both of the simple control and prevention of color deviation.

A second embodiment will now be described which is structured to prevent color deviation caused from the relative velocity between the peripheral velocity of the photosensitive drum 1 and movement velocity of the intermediate transfer belt 4. To prevent color deviation, frictional force which is produced between the photosensitive drum 1 and the intermediate transfer belt 4 must be reduced. Therefore, reduction in the force which is vertically exerted on the contact surface between the two elements is an effective method as described above. In the second embodiment, a low friction material is disposed between the photosensitive drum 1 and the intermediate transfer belt 4.

That is, toner serving as the low friction material is placed on the photosensitive drum 1 at a position in front of the leading end of the toner image in the first color formed on the photosensitive drum 1. Specifically, the yellow developing unit $\mathbf{3}_{-1}$ of the developing unit 3 is, in advance, brought into contact with the photosensitive drum 1. Moreover, the developing bias is applied. Thus, Y toner in a small quantity is left on the photosensitive drum 1 so as to be supplied to the primary transferring portion. As a result, the coefficient of friction between the photosensitive drum 1 and the intermediate transfer belt 4 can be reduced when the first color image, that is, a Y image is formed. As a result, great frictional force causing color deviation to take place is not produced.

Figure 4:
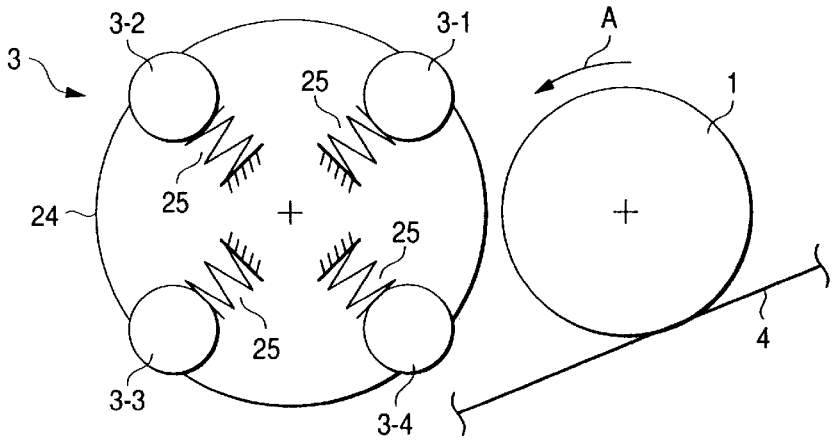
FIG. 4 is a diagram showing the positional relationship between developing units and a photosensitive drum.

FIG. 4 is a diagram showing the relationship between the developing unit 3 and the photosensitive drum 1. Referring to the drawing, the developing unit 3 incorporates a frame member 24 for supporting the developing units $\mathbf{3}_{-1}$ to $\mathbf{3}_{-4}$. The frame member 24 can be rotated by a motor (not shown) in a direction opposite to the photosensitive drum 1, that is, opposite to the direction of the arrow A. Each of the developing units $\mathbf{3}_{-1}$ to $\mathbf{3}_{-4}$ is supported by the frame member 24 such that displacement in the radial direction from the center of rotation of the frame member 24 is permitted. Moreover, the developing units $\mathbf{3}_{-1}$ to $\mathbf{3}_{-4}$ are respectively urged outwards by a spring 25.

The frame member 24 is rotated to the developing position, that is, the contact position with the photosensitive drum 1 in accordance with developing timing of toner in each color. The developing roller is brought into contact with the surface of the photosensitive drum 1 by the pressing force of the spring 25. Note that the developing roller opposes the surface of the photosensitive drum 1 through a tracking roller with a gap.

Usually, the developing roller of the developing unit in each color is positioned at the developing position immediately before the leading end of the latent image in the toner color reaches the developing position. Then, the developing bias is applied. However, this embodiment is structured such that the yellow developing unit $\mathbf{3}_{-1}$ is, in advance, rotated to apply the developing bias only when a first color (yellow) image of a first page is formed.

Figure 5:
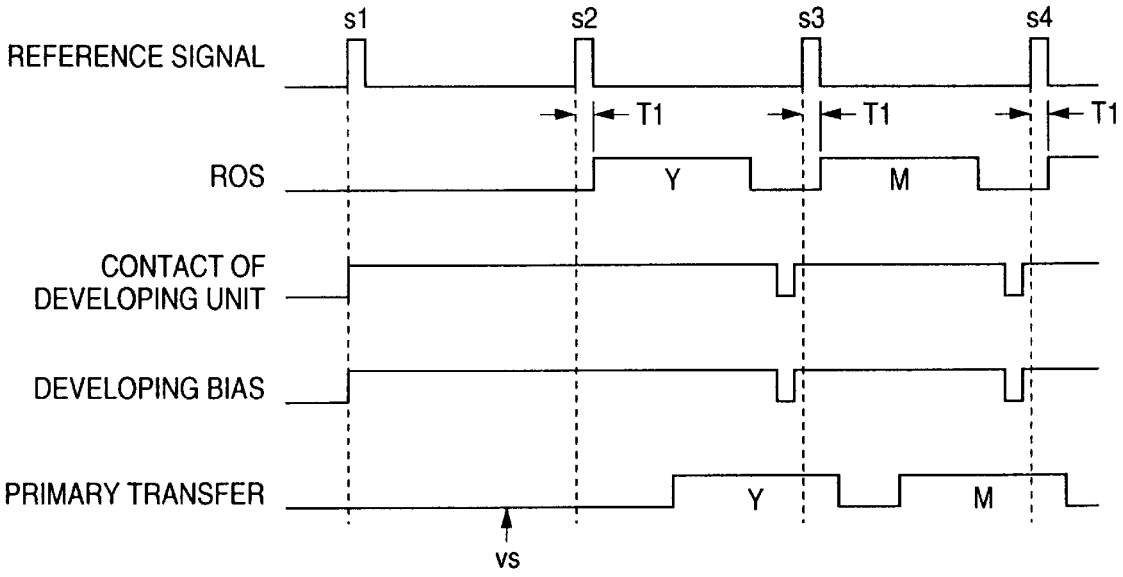
FIG. 5 is a time chart showing essential operations of an image forming apparatus of a second embodiment according to the present invention.

FIG. 5 shows timing at which each developing unit of the developing unit 3 starts the contact and timing at which the developing bias is applied. Note that the primary bias is applied at vs. Referring to the graph, the ROS writes each image after a lapse of time T1 from the first transition of the reference signal after the second rotation. On the other hand, the yellow developing unit $\mathbf{3}_{-1}$ is brought into contact with the photosensitive drum 1 simultaneously with the first reference signal s1. Also the application of the developing bias is performed simultaneously. As a result of the foregoing operation, toner particles exist between the photosensitive drum 1 and the intermediate transfer belt 4 when an image in the first color is written after the reference signal s2.

As described above, the developing unit is brought into contact with the photosensitive drum 1 so as to apply the developing bias in advance to the timing at which the image in the first color is formed. Thus, the toner particles placed on the photosensitive drum 1 serve as low friction materials acting between the photosensitive drum 1 and the intermediate transfer belt 4. Therefore, great frictional force which causes color deviation to take place is not produced. The quantity of the toner particles serving as the low friction materials is a quantity by which toner appears as a so-called background. If a yellow toner image is formed as the first color, the toner is not visually recognized.

Figure 6:
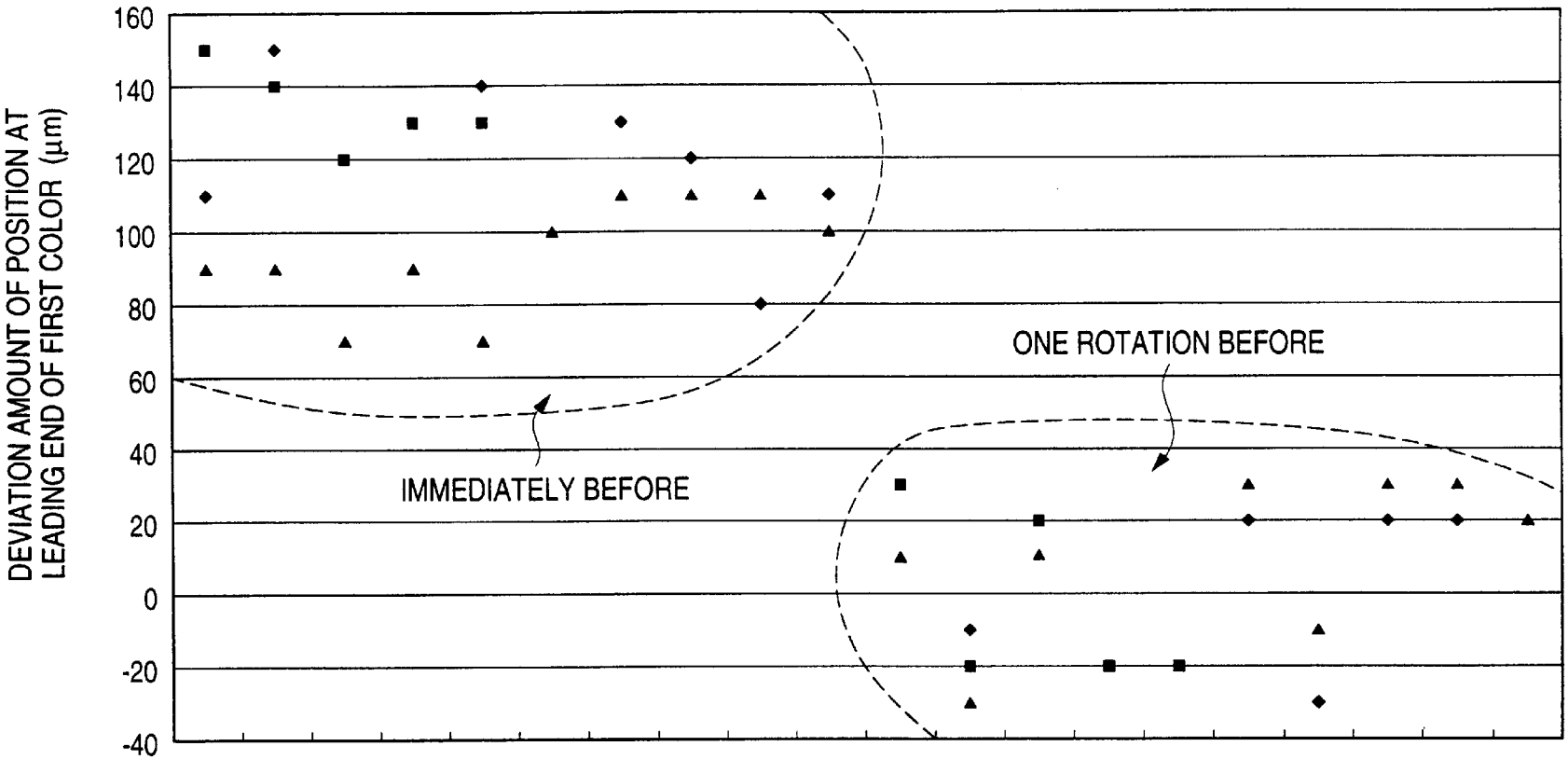
FIG. 6 is a graph showing an amount of deviation of the leading end of a first color corresponding to timing at which a developing bias is applied.

FIG. 6 is a graph showing an amount of color deviation at the leading end of a first color image with respect to the second color image according to the second embodiment. Marks shown in the drawing indicate results of experiments. To cause the graph to easily be understood, results of the experiments are enlarged in the direction of the axis of abscissa. As shown in the graph, when the contact of the developing unit $\mathbf{3}_{-1}$ was made immediately before development of the first color to apply the developing bias, the amount of color deviation was 60 $\mu$m or greater. When the developing unit $\mathbf{3}_{-1}$ was brought into contact with the photosensitive drum 1 about one rotation of the intermediate transfer belt 4 before the start of the formation of the first color image, the amount of color deviation satisfied a range of ±20 $\mu$m.

At the instant when the developing unit 3 is rotated to bring the yellow developing unit $\mathbf{3}_{-1}$ into contact with the photosensitive drum 1, toner particles tend to move to the surface of the photosensitive drum 1 in an excessively large quantity. Therefore, it might be considered feasible to apply the developing bias prior to the contact of the yellow developing unit $\mathbf{3}_{-1}$ to prevent excessive movement of toner particles.

Even if the developing bias is previously applied, contamination sometimes occurs by the toner to an extent which can be visually recognized. Therefore, it is preferable that contamination in the image forming region caused by the toner is prevented when the developing bias is applied prior to writing of a first color image.

To prevent the contamination, it is preferable that the contact of the yellow developing unit $\mathbf{3}_{-1}$ and the application of the developing bias are performed in an inter image portion of the intermediate transfer belt 4, that is, in a region between the two image forming regions. That is, it is preferable that the contact of the yellow developing unit $\mathbf{3}_{-1}$ and the application of the developing bias are performed in the inter image portion at least one rotation before writing of the image in the first color. In the foregoing case, writing of an image in the first color is delayed at least after third reference signal s3.

According to the two embodiments, frictional force between the photosensitive drum 1 and the intermediate transfer belt 4 which is produced when a first color image of a first page can be reduced. Thus, color deviation between the first color and another color caused from great frictional force can be prevented.

The apparatus may be configured so as to further comprise a cleaning member for reducing toner adhered to the intermediate transfer belt 4 prior to the start of writing the image for the first color.

Accordingly, contamination in the image forming region caused by the toner can be prevented.

Figure 7:
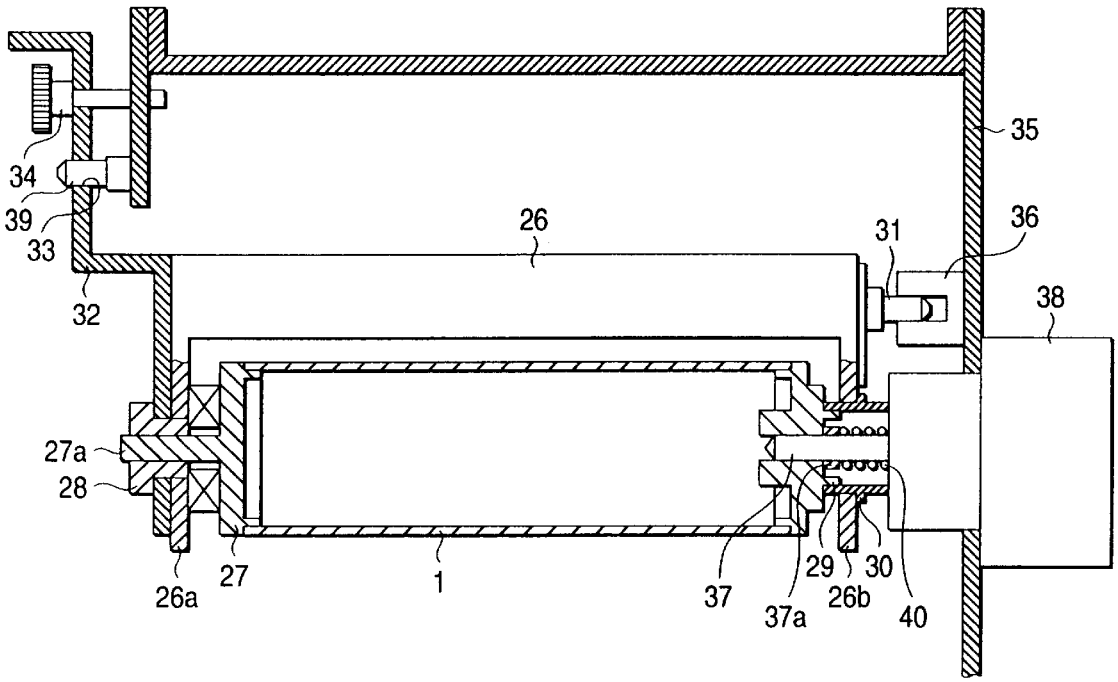
FIG. 7 is a front cross sectional view showing a structure for supporting the photosensitive drum.
Figure 8:
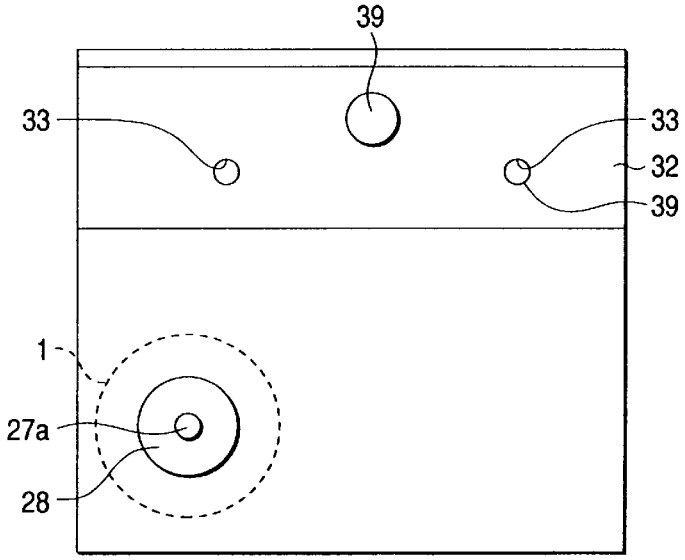
FIG. 8 is a side view showing the structure for supporting the photosensitive drum.
Figure 9:
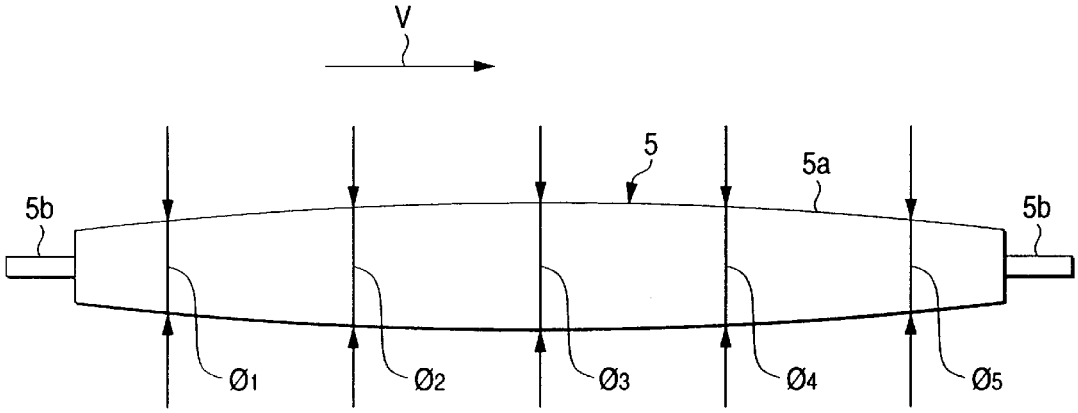
FIG. 9 is a diagram showing the difference in the outer diameter of a transfer roll.

The effect of preventing color deviation realized in the above-mentioned embodiments is improved in the following structure for supporting the photosensitive drum 1. FIG. 7 is a front cross sectional view showing a structure for supporting the photosensitive drum 1. FIG. 8 is a side view thereof. Referring to the drawings, the photosensitive drum 1 is supported by a housing 26. A side plate 26*a* of the housing 26 is provided with a bearing 28 for supporting a shaft 27*a* of one flange 27 of flanges of the photosensitive drum 1. Another side plate 26*b* is provided with a sleeve 30 for guiding the outer periphery of a boss 29*a* formed on the other flange 29 of flanges of the photosensitive drum 1. A positioning pin 31 is provided for the outer surface of the side plate 26*b* of the housing 26. A bracket 32 is secured to the outer surface of the side plate 26*a*. The bracket 32 has locating holes 33 and a latch shaft 34.

On the other hand, a bearing 36, into which the positioning pin 31 is inserted, is secured to the frame 35 of the image forming apparatus. Moreover, a motor 38 having a shaft 37 which is inserted into a central hole of the flange 29 is secured to the frame 35. In addition, the frame 35 is provided with positioning pins 39, which are inserted into the locating holes 33 provided for the bracket 32, and a latch hole (not shown) to which the leading end of the latch shaft 34 is engaged. The shaft 37 of the motor 38 has a joint 37*a* which is engaged with the flange 29. The joint 37*a* is urged in a direction of the leading end of the shaft 37 by a spring 40 so as to reliably be engaged with the flange 29.

The photosensitive drum 1 is in a state in which it is temporarily supported by the housing 26 by dint of the bearing 28 and the sleeve 30 until the photosensitive drum 1 is accommodated in the frame 35. That is, the positioning pins 31 and 39 are engaged with the corresponding bearing 36 and locating holes 33. Moreover, the shaft 37 of the motor 38 is engaged with the flange 29. In addition, the latch shaft 34 is latched by the frame 35 so that the photosensitive drum 1 is supported at a predetermined position in the image forming apparatus.

The structure for supporting the photosensitive drum 1 enables the photosensitive drum 1 to easily be attached/detached to and from the image forming apparatus. Thus, workability in changing and inspecting the apparatus can be improved. The engagement between the engagement pins and corresponding holes is performed loosely as compared with the structure in which a shaft which penetrates the central portion of the photosensitive drum 1 is provided and the shaft is received by the frame. Therefore, the above-mentioned support structure easily causes deviation of the position if great frictional force is exerted by the relative velocity produced between the photosensitive drum 1 and the intermediate transfer belt 4.

If the frictional force which is produced when the primary transference is performed can be reduced as described above, deviation of the position which causes color deviation of the first color can be prevented even in the above-mentioned support structure which facilitates attaching and detachment.

As described above, according to the present invention, deviation of the image carrier and the intermediate transfer belt caused from the frictional force produced between the image carrier and the intermediate transfer belt to an extent with which deviation of the position of a first color image takes place can be prevented. Therefore, the problem in that the leading end of the first color image is deviated from images in the second and following colors can be prevented.

A third embodiment will now be described with reference to the accompanying drawings.

Figure 16:
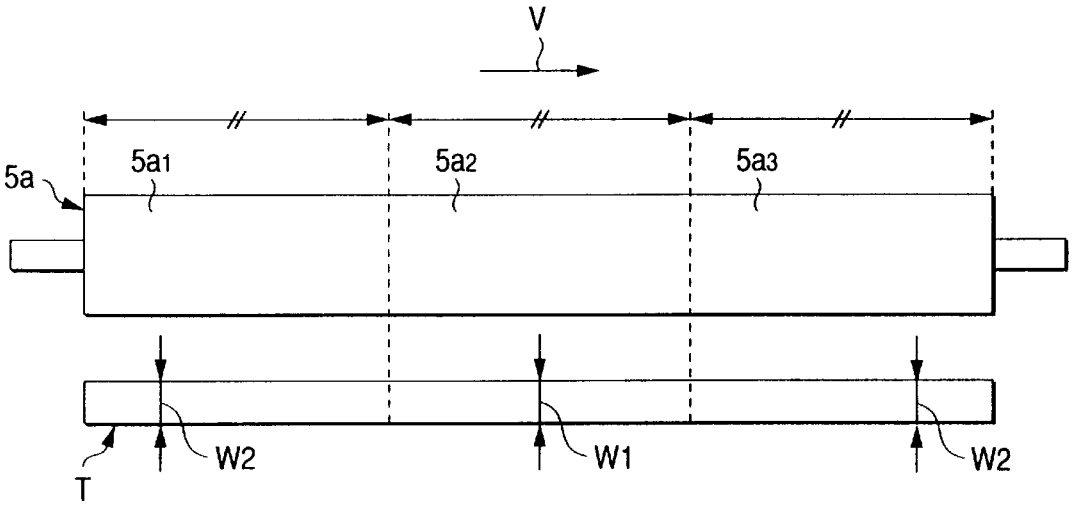
FIG. 16 is diagram showing other positions at which the nip widths W1 and W2 can be measured.

As shown in FIG. 16, the transfer roller 5 according to the first embodiment incorporates a roller portion 5*a* and a shaft 5*b* inserted into the central portion of the roller portion 5*a*. The transfer roller 5 is urged to the photosensitive drum 1 (see FIG. 1) at the both ends of the shaft 5*b* thereof.

The volume resistivity of the transfer roller 5 is selected in the range of $10^4$ Ω·cm to $10^9$ Ω·cm. As the material of the transfer roller 5, sponge type foam urethane having hardness of 25° to 45° (a measured value according to the ASKER C which is a device or a method for measuring a hardness of relatively soft rubbers or sponges) is employed. If the volume resistivity is $10^4$ Ω·cm to $10^9$ Ω·cm and the hardness is 25° to 45°, another material, such as EPDM or silicon rubber may be employed as the material of the transfer roller 5. The outer diameter of the photosensitive drum 1 is set to be 84 mm, while the outer diameter of the transfer roller 5 is set to be about 19 mm.

The transfer roller 5 is structured such that the outer diameter of the roller portion 5*a* is gradually enlarged from the both ends toward the central portion in axial direction V. That is, outer diameter Φ3 at the central portion is a maximum outer diameter. Moreover, the outer diameters are set such that outer diameter Φ1<outer diameter Φ2<outer diameter Φ3. In addition, the relationship that outer diameter Φ5<outer diameter ∠4< outer diameter Φ3 is satisfied. Therefore, the pressing force of the transfer roller 5 exerted on the intermediate transfer belt 4 and the photosensitive drum 1 can gradually be enlarged from the two axial directional ends toward the central portion.

In the structure according to this embodiment in which the transfer roller 5 is urged at the two axial directional ends, the pressing force of the transfer roller 5 is usually enlarged at the both ends as compared with that of the central portion with respect to the axial direction. Therefore, the nip width W2 is usually larger than the nip width W1. However, the above-mentioned structure is able to correct dispersion of the pressing force of the transfer roller 5 in the axial direction.

If the difference between the maximum value and the minimum value of the outer diameter of the transfer roller 5 is excessively great, there is apprehension that irregularity in transference occurs owning to the difference in the outer diameter. Therefore, the difference between the maximum value and the minimum value of the outer diameter is set to satisfy a range from about 0.1% to 0.9% of an average value (for example, 19 mm) of the outer diameters.

Figure 15:
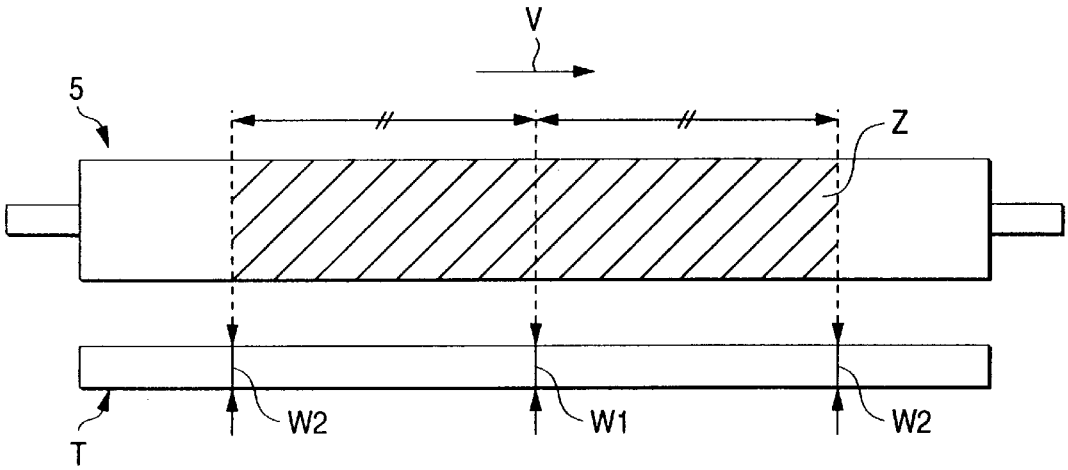
FIG. 15 is a diagram showing positions at which nip widths W1 and W2 according to the first embodiment are measured.

The nip shape index is expressed by the ratio (=nip width W2/nip width W1) of the nip width W2 of the contact region T at the axial directional end of a toner-image transfer region Z of the transfer roller 5 shown in FIG. 15 with respect to the nip width W1. The nip width W1 is the width of the contact region T between the photosensitive drum 1 and the intermediate transfer belt 4 and corresponding to the axial directional central portion of the region (the toner-image transfer region) Z which contributes to transference of toner images. As a result of the above-mentioned structure, the nip shape index is set to satisfy the range (1±0.3).

Figure 10:
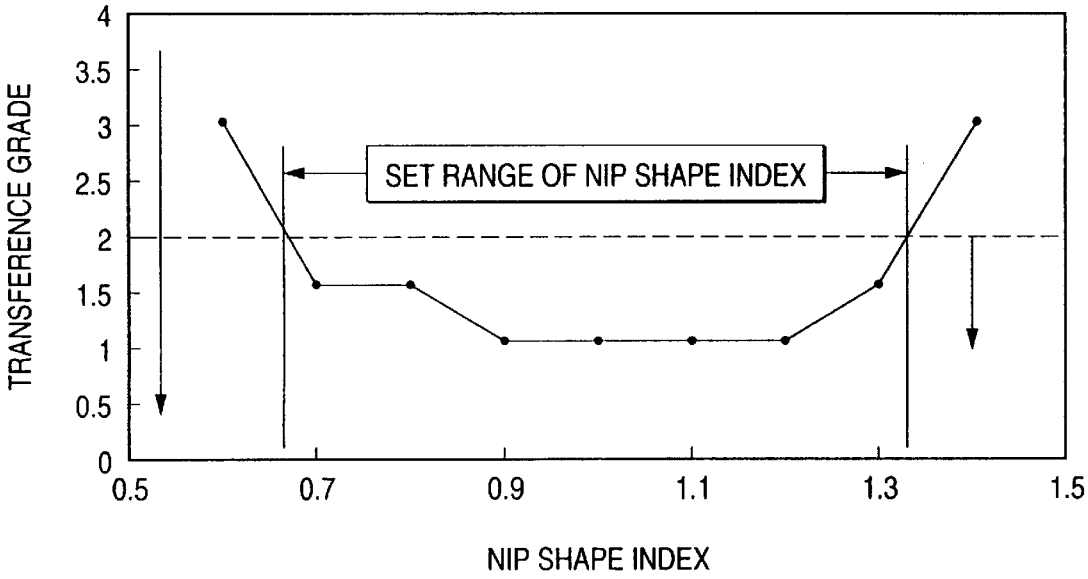
FIG. 10 is a graph showing the relationship between nip shape indexes and transference grades.

Since the nip shape index is set to satisfy the above range, partial irregularity in transference occurring when toner images on the photosensitive drum 1 are transferred to the intermediate transfer belt 4 can be prevented. Thus, the transference grade of 2 or lower can be maintained as described with reference to FIG. 10. As a result, a satisfactory quality of the transferred image can be maintained.

As shown in FIG. 16, the position at which the nip width W1 is measured may be an arbitrary position in the contact region T between the photosensitive drum 1 and the intermediate transfer belt 4 and corresponding to a central divided region 5*a*2 obtained by dividing the roller portion 5*a* into three sections in the axial direction V. The position at which the nip width W2 is measured may be an arbitrary position in the contact region T corresponding to the divided regions 5*a*1 and 5*a*3 at the both ends.

The third embodiment has been described about the structure in which the outer diameter of the transfer roller 5 is gradually enlarged from the two axial directional ends toward the central portion. However, another roller may be employed to be disposed opposite to the photosensitive drum 1 across the transfer roller 5. The roller has the outer diameter which is gradually enlarged from the both ends toward the central portion in the axial direction. When the foregoing roller is rotated, dispersion of the pressing force of the transfer roller 5 occurring in the axial direction can be corrected.

A fourth embodiment will now be described with reference to the accompanying drawings.

Figure 11:
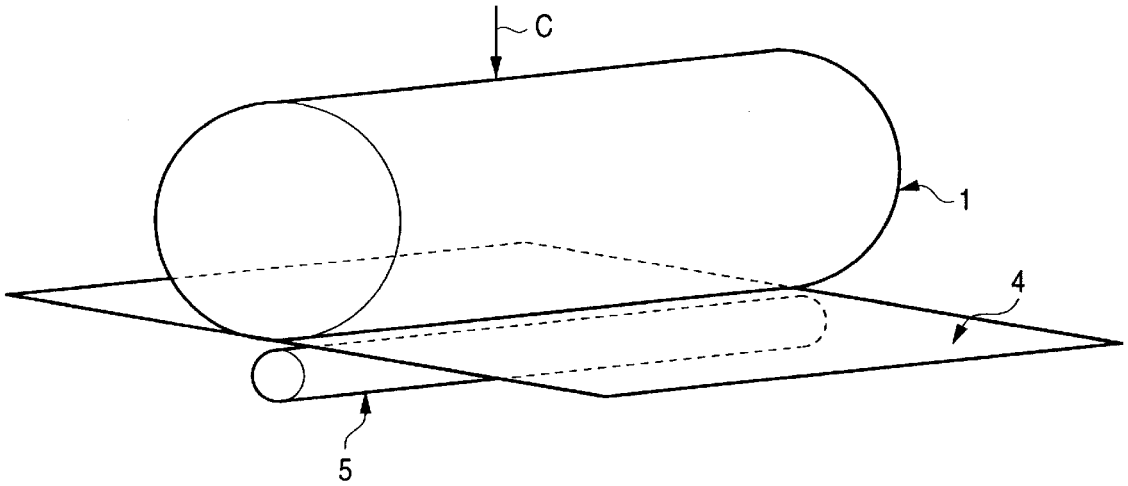
FIG. 11 is a diagram showing an amount of skew of the transfer roll.
Figure 12:
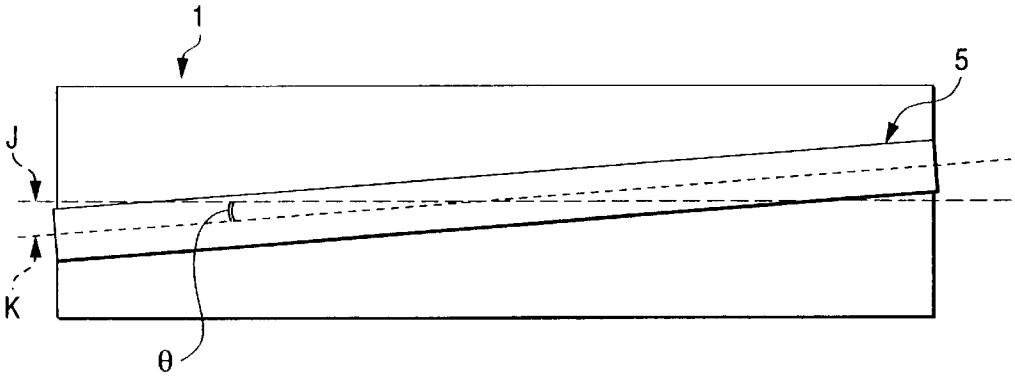
FIG. 12 is a projection view taken from a direction indicated with an arrow C shown in FIG. 11.

FIG. 11 shows the positions of the photosensitive drum 1, the transfer roller 5 and the intermediate transfer belt 4. When projection is performed from a direction indicated with an arrow C perpendicular to the surface of the intermediate transfer belt 4, the transfer roller 5 according to the second embodiment is, as shown in FIG. 12, disposed such that its central axis K is inclined from a central axis J of the photosensitive drum 1 at a predetermined angle which is 2° or smaller.

Figure 13:
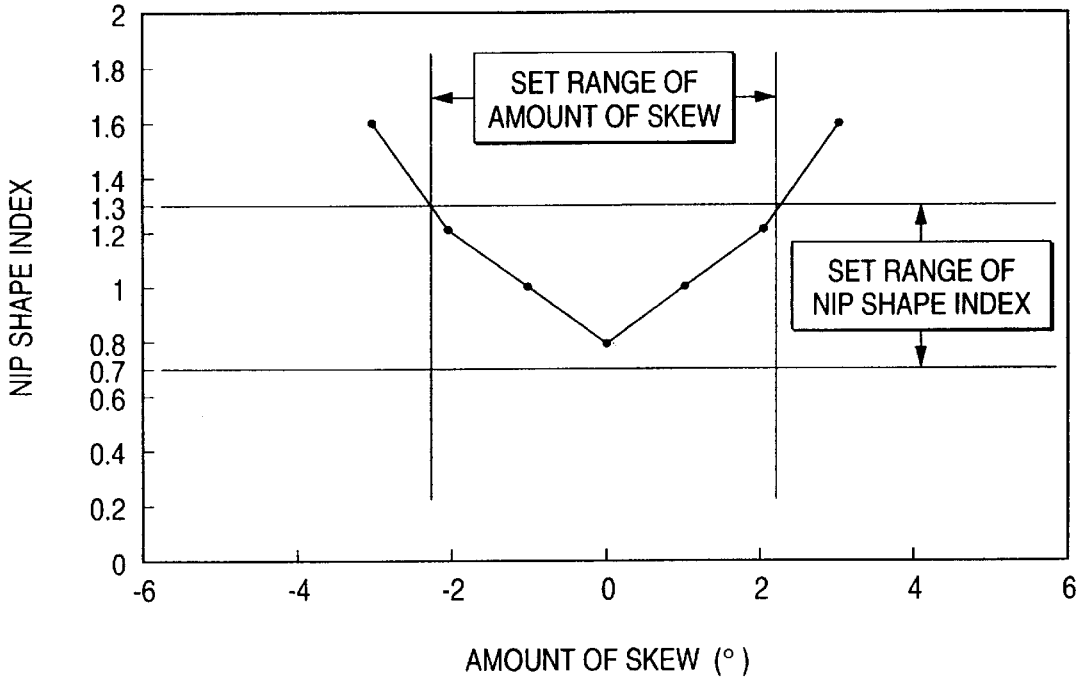
FIG. 13 is a graph showing the relationship between amounts of skew of the transfer roller and the nip shape indexes.
Figure 14:
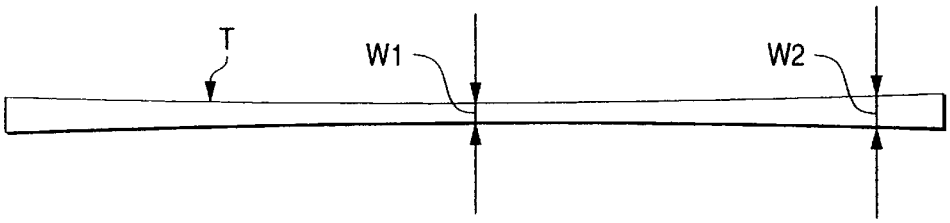
FIG. 14 is a diagram showing a contact region between the photosensitive drum and the intermediate transfer belt and the nip width.

The inclination angle $\theta(\theta \leqq 2°)$ is called an amount of skew of the transfer roll. The amount of skew of the transfer roller according to the fourth embodiment and the nip shape index (=nip width W2/nip width W1) have a correlation as shown in a graph shown in FIG. 13. As shown in FIG. 13, when the nip shape index is 0.8 in a case where the amount of skew of the transfer roller is 0°, the nip shape index is about 1 in a case where the amount of skew of the transfer roller is ±1°. When the amount of skew of the transfer roller is ±2°, the nip shape index is about 1.2.

That is, the fourth embodiment is structured to have the amount of skew of the transfer roller which satisfies a predetermined angle which is 2° or smaller. Therefore, the nip shape index satisfies a range from 0.7 to 1.3, similarly to the third embodiment.

As a result, partial irregularity in transference occurring when toner images on the photosensitive drum 1 are transferred to the intermediate transfer belt 4 can be prevented. Thus, the transference grade shown in FIG. 10 can be maintained at 2 or lower. As a result, a satisfactory quality of the transferred image can be maintained.

In the third and fourth embodiments, the transfer roller 5 may be disposed downstream of the contact region between the photosensitive drum 1 and the intermediate transfer belt 4 in the conveying direction. In the foregoing case, vibrations of the transfer roller 5 which are produced when a transference operation is performed can be reduced as compared with the structure in which the transfer roller 5 is disposed immediately below the contact region. Thus, change in the pressing force of the transfer roller 5 can be prevented. As a result, partial irregularity in transference can furthermore satisfactorily be prevented.

As described above, according to the present invention, the nip width W1 and the nip width W2 are made to be substantially the same when the nip shape index satisfies the range (1± allowable value). Thus, dispersion of the nip widths occurring in the axial direction can be prevented to satisfy the allowable range. Therefore, partial irregularity in transference occurring when toner images on the image carrier are transferred to the intermediate transfer belt can be prevented. As a result, a satisfactory quality of the transferred image can be maintained at a level not lower than a predetermined level.

What is claimed is:

1. An image forming apparatus for forming a color image with plural colors of toner in accordance with an input image signal, the image forming apparatus comprising:

a rotatable image carrier having a shaft as a rotation axis;

an image writing means for forming an electrostatic latent image on the image carrier in accordance with the image signal;

a developing means for applying a developing bias to the image carrier to visualize the latent image as a toner image with the plural colors of toner;

a transfer belt an outer surface of which is contacted with an outer peripheral surface of the image carrier while being conveyed in a predetermined conveying direction along a predetermined loop passage;

a rotatable transfer roller having a shaft as a rotation axis, the transfer roller disposed opposite to the image carrier across the transfer belt for urging the transfer belt toward the image carrier at a transferring position;

a friction reducing means for reducing friction between the image carrier and the transfer belt before a leading end portion of the toner image for a first color arrives at the transferring position; and a bias applying means for applying a transfer bias to the transfer roller to transfer the visualized toner image onto the transfer belt to serve as the friction reducing means.

2. The image forming apparatus as set forth in claim 1 further comprising:

an identifier provided on the transfer belt; and sensor for detecting the identifier to identify the present position of the transfer belt in the loop passage and for outputting a reference signal, wherein the image writing means starts the latent image formation of the first color in response to the output of the reference signal and the bias applying means starts the application of the transfer bias after a lapse of a predetermined time from the output of the reference signal.

3. An image forming apparatus for forming a color image with plural colors of toner in accordance with an input image signal, the image forming apparatus comprising:

a rotatable image carrier having a shaft as a rotation axis;

an image writing means for forming an electrostatic latent image on the image carrier in accordance with the image signal;

a developing means for applying a developing bias to the image carrier to visualize the latent image as a toner image with the plural colors of toner;

a transfer belt an outer surface of which is contacted with an outer peripheral surface of the image carrier while being conveyed in a predetermined conveying direction along a predetermined loop passage;

a rotatable transfer roller having a shaft as a rotation axis, the transfer roller disposed opposite to the image carrier across the transfer belt for urging the transfer belt toward the image carrier at a transferring position; and a friction reducing means for reducing friction between the image carrier and the transfer belt before a leading end portion of the toner image for a first color arrives at the transferring position;

wherein the developing means starts to apply the developing bias for the first color to serve as the friction reducing means at least one rotation of the transfer belt prior to the start of latent image forming for the first color performed by the image writing means.

4. The image forming apparatus as set forth in claim 3, wherein the developing bias is applied to an image center portion on the transfer belt.

5. The image forming apparatus as set forth in claim 3 further comprising:

cleaning means for reducing toner adhered to the transfer belt prior to the start of latent image forming for the first color.

6. An image forming apparatus for forming a color image with plural colors of toner in accordance with an input image signal, the image forming apparatus comprising:

a rotatable image carrier having a shaft as a rotation axis;

an image writing means for forming an electrostatic latent image on the image carrier in accordance with the image signal;

a developing means for applying a developing bias to the image carrier to visualize the latent image as a toner image with the plural colors of toner;

a transfer belt an outer surface of which is contacted with an outer peripheral surface of the image carrier while being conveyed in a predetermined conveying direction along a predetermined loop passage;

a rotatable transfer roller having a shaft as a rotation axis, the transfer roller disposed opposite to the image carrier across the transfer belt for urging the transfer belt toward the image carrier at a transferring position;

a friction reducing means for reducing friction between the image carrier and the transfer belt before a leading end portion of the toner image for a first color arrives at the transferring position;

a frame in which a motor for driving the image carrier is securely mounted; and a housing detachably mounted in the frame and having a bearing for rotatably supporting one end of the shaft of the image carrier, wherein the other end of the shaft is engaged with a shaft of the motor and supported thereby when the housing is mounted in the frame.

7. An image forming apparatus for forming a color image with plural colors of toner in accordance with an input image signal, the image forming apparatus comprising:

a rotatable image carrier having a shaft as a rotation axis;

an image writing means for forming an electrostatic latent image on the image carrier in accordance with the image signal;

a developing means for applying a developing bias to the image carrier to visualize the latent image as a toner image with the plural colors of toner;

a transfer belt an outer surface of which is contacted with an outer peripheral surface of the image carrier while being conveyed in a predetermined conveying direction along a predetermined loop passage;

a rotatable transfer roller having a shaft as a rotation axis, the transfer roller disposed opposite to the image carrier across the transfer belt for urging the transfer belt toward the image carrier at a transferring position; and a friction reducing means for reducing friction between the image carrier and the transfer belt before a leading end portion of the toner image for a first color arrives at the transferring position;

wherein a nip shape index represented by a ratio of a contact area width of the image carrier and the transfer belt at an end portion of the transfer roller with respect to an axial direction thereof to that at a central portion of the transfer roller with respect to the axial direction is set within a range of $(1\pm x)$, where x is an allowable value determined under a setting condition of the apparatus.

8. The image forming apparatus as set forth in claim 7, wherein the value of x is 0.3.

9. The image forming apparatus as set forth in claim 7, wherein the central portion is defined as an arbitrary portion in a central area derived by dividing the transfer roller into three equal areas in the axial direction, and the end portion is defined as an arbitrary portion in one of both side areas derived by the dividing.

10. The image forming apparatus as set forth in claim 7, wherein the central portion is defined as a portion corresponding to a central portion in a central portion of a toner image transferred area with respect to axial direction of the transfer roller, and the end portion is defined as a portion corresponding to one of both side end portions of the toner image transferred area.

11. The image forming apparatus as set forth in claim 7, wherein an outer diameter of the transfer roller is gradually enlarged from both side end portions toward a central portion along an axial direction thereof.

12. The image forming apparatus as set forth in claim 11, wherein a difference between a maximum value of the outer diameter and a minimum value of the same satisfies a range from 0.1–0.9% of an average value of the outer diameters.

13. The image forming apparatus as set forth in claim 7, wherein the transfer roller is disposed such that the shaft thereof makes a predetermined angle with respect to a plane perpendicular to the transfer belt and including the shaft of the image carrier.

14. The image forming apparatus as set forth in claim 13, wherein the angle is determined in accordance with the nip shape index.

15. The image forming apparatus as set forth in claim 7, wherein the transfer roller is arranged at a near downstream portion of the conveying direction with respect to a contact region of the image carrier and the transfer belt.

* * * * *